US007240393B2

(12) United States Patent
Shyu

(10) Patent No.: US 7,240,393 B2
(45) Date of Patent: Jul. 10, 2007

(54) AUTOMATIC CLEAN DEVICE

(75) Inventor: Devon Shyu, Tainan Hsien (TW)

(73) Assignee: Avision Inc., Hsinchu (TW)

( * ) Notice: Subject to any disclaimer, the term of this patent is extended or adjusted under 35 U.S.C. 154(b) by 585 days.

(21) Appl. No.: 10/747,340

(22) Filed: Dec. 29, 2003

(65) Prior Publication Data

US 2004/0253029 A1 Dec. 16, 2004

(30) Foreign Application Priority Data

Jun. 12, 2003 (TW) ..... 92210715 U

(51) Int. Cl.
*B41F 35/06* (2006.01)

(52) U.S. Cl. ..... 15/256.51; 15/256.53; 118/104; 118/203

(58) Field of Classification Search ..... 15/256.51, 15/256.53; 118/104, 203, 261; 198/499; 162/198, 199, 272, 275, 281
See application file for complete search history.

(56) References Cited

U.S. PATENT DOCUMENTS 2,318,504 A * 5/1943 Lodding ..... 15/256.53
2,393,724 A * 1/1946 Vickers ..... 198/499
3,017,828 A * 1/1962 Behringer ..... 101/157
3,577,649 A * 5/1971 Wadsworth et al. ..... 34/110
3,659,553 A * 5/1972 Tobias ..... 118/261
3,802,339 A * 4/1974 Andersson et al. ..... 100/174
3,853,045 A * 12/1974 Marrie ..... 99/423
3,863,453 A * 2/1975 Mercier ..... 60/539
3,918,400 A * 11/1975 Cheeseman ..... 118/261
4,151,797 A * 5/1979 Dunsirn ..... 101/169
4,201,918 A * 5/1980 Latzer ..... 250/433
4,305,821 A * 12/1981 Crandall et al. ..... 210/396
4,314,504 A * 2/1982 Combeau ..... 101/41
4,385,960 A * 5/1983 Zodrow et al. ..... 156/568
4,509,225 A * 4/1985 Haugen ..... 15/256.51
4,676,160 A * 6/1987 Linska ..... 101/365
4,694,952 A * 9/1987 Meijer ..... 198/499
4,716,826 A * 1/1988 Gibellino et al. ..... 101/169
4,919,756 A * 4/1990 Sawdai ..... 162/111
5,007,523 A * 4/1991 Morefield ..... 198/497
6,283,274 B1 * 9/2001 Dolan et al. ..... 198/499

OTHER PUBLICATIONS

European Patent Office 1 266 888 Jun. 2000.*

* cited by examiner

*Primary Examiner*—Frankie L. Stinson

(57) ABSTRACT

An automatic clean device includes a base body, a transmission element, a cleaning element and an elastic member. Wherein the transmission element and the cleaning element are disposed on the base body, the elastic member has an end connected to the cleaning element. With the cooperation of the transmission element and the elastic member, the cleaning element is able to oscillate reciprocatedly and alternately touch a photoconductor of the laser-type image/data recording device. By this way, the cleaning element is able to clean the toner that is remained on the surface of the photoconductor.

4 Claims, 5 Drawing Sheets

AUTOMATIC CLEAN DEVICE

BACKGROUND OF THE INVENTION

1. Field of the Invention

The present invention relates to an automatic clean device, and more particularly to a clean device which is disposed in laser-type image/data recording device (such as printer, copier, fax machine and the likes) for cleaning the imaging material (such as toner) attaching on the surface of a photoconductor of the laser image/data recording device.

2. Description of the Prior Arts

The operating principle of a conventional laser-type image/data recording device, such as copier, printer or fax machine, is to change the image or data of original copy into rays, so as to expose the surface of photoconductor which is fully distributed with static. When the photoconductor rotate to a toner cartridge, the toner will be attracted on unexposed portion of the photoconductor, after processes of transcribing and photographic fixing, and then the image/data can be printed on paper. The light source applied in the current laser-type image/data recording device generally includes laser light and LED.

In the operation of the above-mentioned laser-type image/data recording device, not will all the powdered carbon on the surface of the photoconductor be attracted on the paper, the reason is that the particles of the powdered carbon are average in diameter, which are varied from 5 μm to 15 μm. The Vander Wals electric field has relative weak attraction for the small particles of powdered carbon, in this case, the small particles of toner are uneasy to be attached on the paper and will remain on the photoconductor. In order to ensure the printing quality, the photoconductor should be cleaned regularly.

Takes a laser printer as an example, as shown in FIG. 1, wherein a photoconductor 10 of the laser printer can be cleaned by using at least a blade 12 to touch the photoconductor 10, so as to clean the remainders of powdered carbon off the surface of the photoconductor 10. The blade 12 can be put along or counter to the rotating direction of the photoconductor 10.

The photoconductor 10 can rotate repeatedly, when the blade 12 touches the photoconductor 10 to clean the remainder of toner, since there is relative motion between the blade 12 and the photoconductor 10, further due to the blade 12 is disposed at different angle with respect to the photoconductor 10, in this case, the blade 12 is susceptible to being driven to move by the photoconductor 10, which will result in over deflection along the rotating direction of the photoconductor 10 or deformation of the blade 12 (as pointed by the solid line), or in alternative, which will result in over deflection of the blade 12 (as pointed by the dotted line) which is counter to the rotating direction of the photoconductor 10 or deformation of the blade 12. And thus will further result in abrasion on the surface of the photoconductor 10. Thereby, the conventional blade 12 is not only unable to provide good cleaning function but also will cause damage of the components.

In addition, the blade 12 is fixed at a predetermined position, it accordingly keeps touching the photoconductor 10 all the time. In this case, the photoconductor 10 and the blade 12 of the prior arts are more susceptible to abrasion with respect to that of the present invention.

The above-mentioned photoconductor 10 can be photoconductive drum or photoconductive belt.

The present invention has arisen to mitigate and/or obviate the afore-described disadvantages of the conventional automatic clean device for laser-type image/data recording device.

SUMMARY OF THE INVENTION

The primary object of the present invention is to provide an automatic clean device which is capable of automatically touching and disengaging from an photoconductor, so as to implement cleaning operation.

The secondary object of the present invention is to provide an automatic clean device which is capable of preventing over deflection of cleaning element.

The secondary object of the present invention is to provide an automatic clean device which is capable of reducing the abrasion of photoconductor.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENTS

Figure 1:
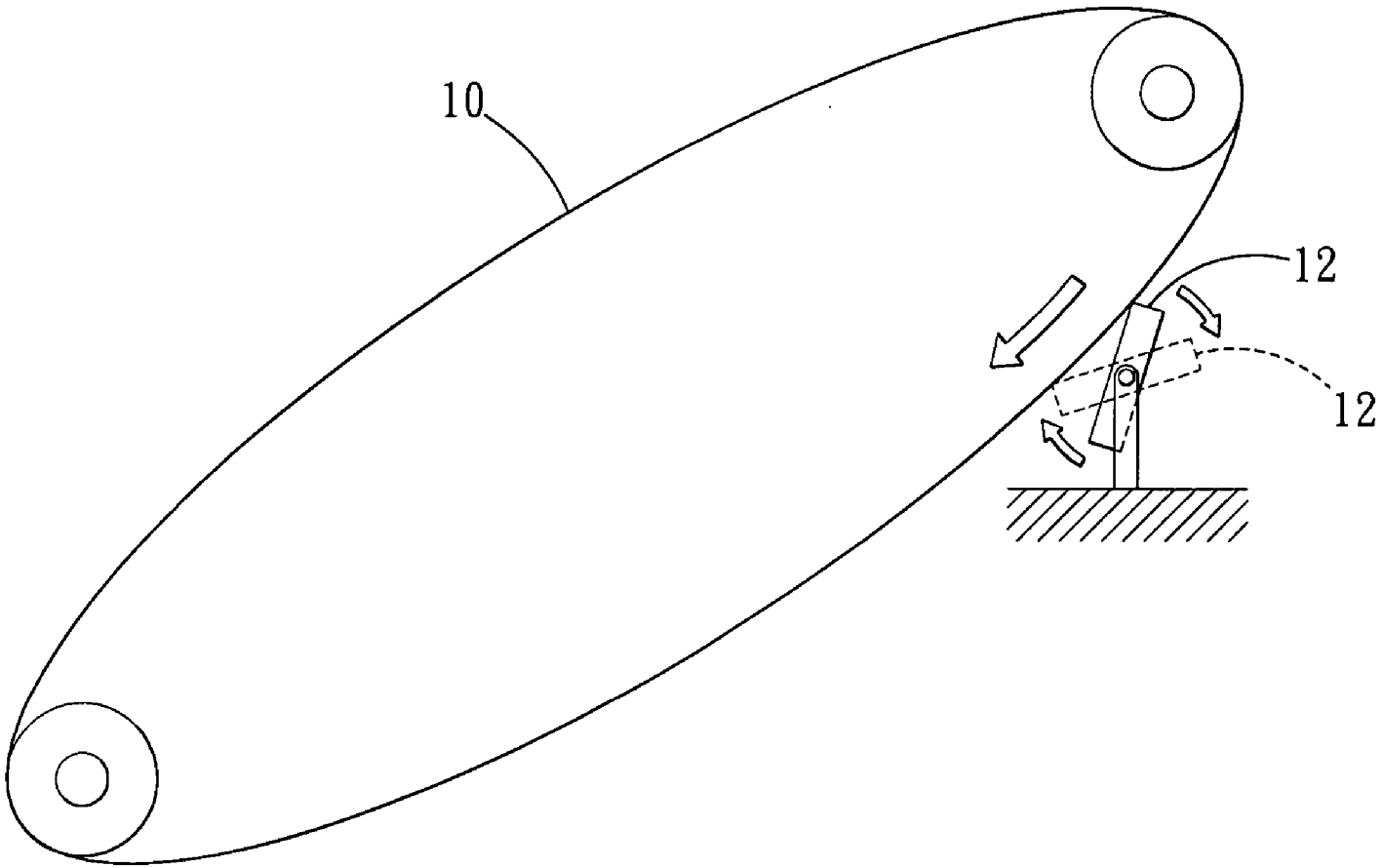
FIG. 1 PRIOR ART
FIG. 1 is an illustrative view of a conventional clean device.
Figure 2:
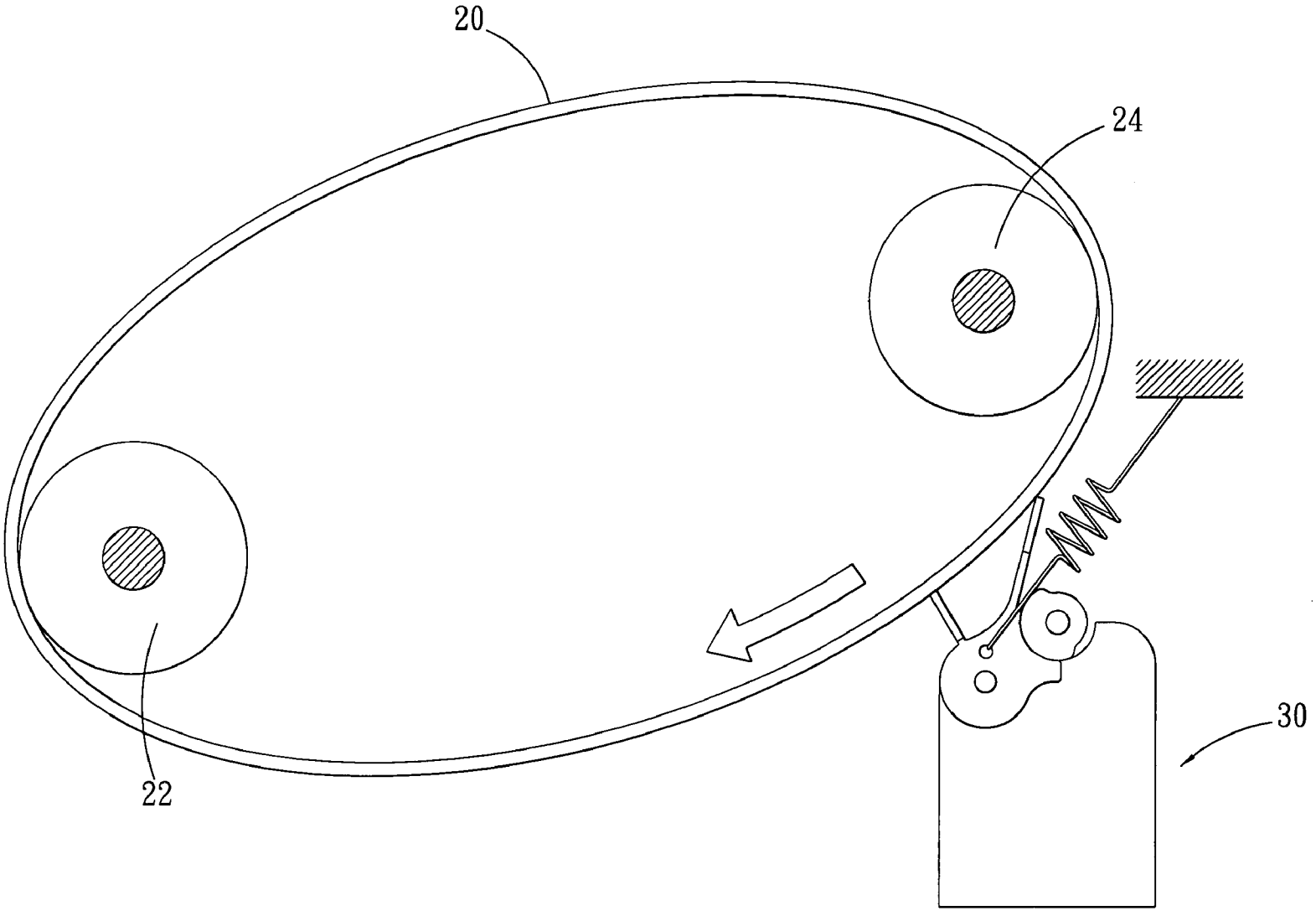
FIG. 2 is an illustrative view of showing an automatic clean device of the present invention contacting a photoconductor.

Referring to FIG. 2, which shows a photoconductor 20 and a cleaning device 30. The photoconductor 20 is strip-shaped, with the cooperation of at least two rollers 22, 24, the photoconductor 20 is able to rotate repeatedly. On the surface of the photoconductor 20 is coated with photosensitive material for purpose of optical exposure and display.

Figure 3:
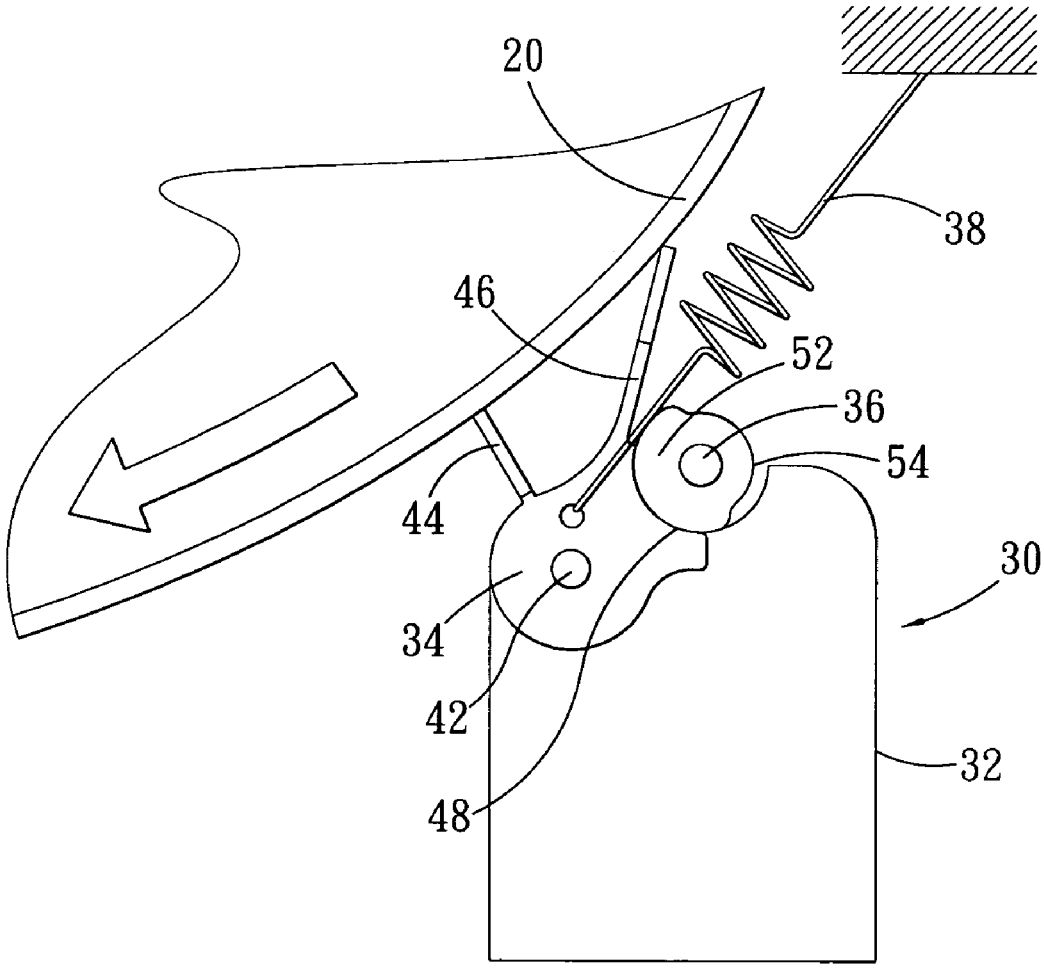
FIG. 3 is another illustrative view of FIG. 2.

Referring to FIG. 3, wherein the cleaning device 30 includes a base body 32, a cleaning element 34, a transmission element 36 and an elastic member 38.

The cleaning element 34 has a coupling portion 42 fixed to the base body 32, on a side of the cleaning element 34 is formed with a first blade 44 and a second blade 46, the first blade 44 and the second blade 46 are oppositely located by forming a "V" shape. On another side of the cleaning element 34 is formed with a negative-arc formed sliding groove 48 that corresponds the transmission element 36.

The transmission element 36 is a structure and has a top surface engaged in the sliding groove 48 of the cleaning element 34. The cam-structured transmission element 36 includes a push portion 52 and an arresting portion 54, it can driven to constantly rotate by a power supply or can be controlled to alternately rotate at predetermined time. The push portion 52 is arc-shaped to engage the arc-shaped sliding groove 48 of the cleaning element 34.

The elastic member 38, an end of which is coupled to the cleaning element 34 and another end of the same is fixed. It should be noted that the elastic member 38 is coupled on the cleaning element 34 in a pulling manner, thus there will be a restoring force acting on the cleaning element 34.

Figure 4:
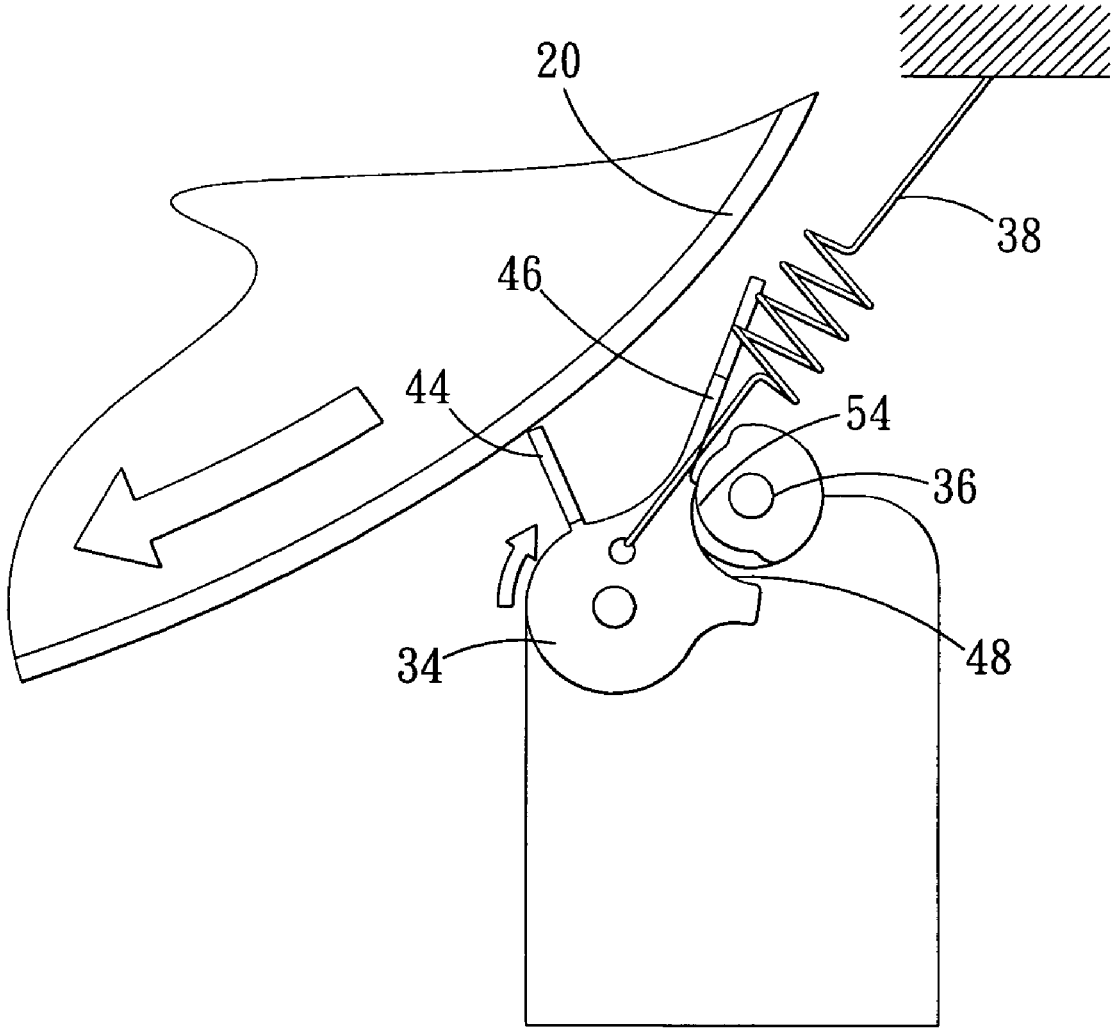
FIG. 4 is a third illustrative view of FIG. 2.

Referring to FIG. 4, during the operation of a printer, the photoconductor 20 will rotate for charge distribution and photosensitization. The arresting portion 54 of the transmission element 36 is engaged in the sliding groove 48 of the cleaning element 34. The cleaning element 34 will oscillate under the influence of the restoring force of the elastic member 38, in this way, the first and the second blades 44, 46 are disengaged from the photoconductor 20.

In the above state, although the cleaning member 34 is pulled by the elastic member 38, it is impossibly overly deflected under the influence of the restoring force of the elastic member 38 due to the cleaning element 34 is stopped by the transmission element 36.

Referring to FIG. 3 again, when the photoconductor 20 finishes its work, the surface of which attached with remainder of powered carbon rotates to approach the cleaning element 34, the transmission element 36, under the influence of the rotation, makes the push portion 52 engage in the sliding groove 48. At the moment, the cleaning element 34 is pushed to oscillate by the transmission element 36, and thus the first and the second blades 44, 46 are allowed to touch the surface of the photoconductor 20. In this way, the remainders (such as toner) can be effectively removed.

The cleaning element 34 keeps touching the photoconductor 20 till the remainders have been removed completely. After that, the cleaning element 34, under the influence of the transmission element 36, will disengage from the photoconductor 20. The time of the cleaning element 34 touching the photoconductor 20 depends on the size of the photoconductor 20.

It should be noted that when the first blade 44 touches the surface of the photoconductor 20, the second blade 46 would follow to touch the surface of the photoconductor 20. When the first and the second blades 44, 46 touch the photoconductor 20, since they are opposite located by forming a "V" shape, the first and the second blades 44, 46 each is located at a different angle with respect to the photoconductor 20. As a result, the photoconductor 20 will have different pitching moments on the first blade 44 and the second blade 46 respectively. And thus the two different moments will counteract to each other so as to prevent deflection or deformation of the cleaning element 34 which caused by the photoconductor 20 overly deflecting toward only one of the blades.

The cleaning element 34 is pushed by the push portion 36 and simultaneously pulled by the elastic member 38, and thus the cleaning element 34 is possessed with self-guiding ability. At the initial rotation course of the photoconductor 20, the cleaning element 34 doesn't touch the photoconductor 20 cause there is no remainders of powdered carbon attached on the surface of the photoconductor 20. When the portion on the surface of the photoconductor 20 is attached with remainders of toner and approaches the cleaning element 34, the transmission element 36 will push the cleaning element 34 to make it touch the photoconductor 20, such that a cleaning operation is carried out. By this way, the time of the photoconductor 20 touching the cleaning element 34, during each operation of the laser type image/data recording device, is shorter than that of the prior arts. Thereby, the photoconductor 20 and the cleaning element 34 can be prevented from being abraded after long time of usage.

Figure 5:
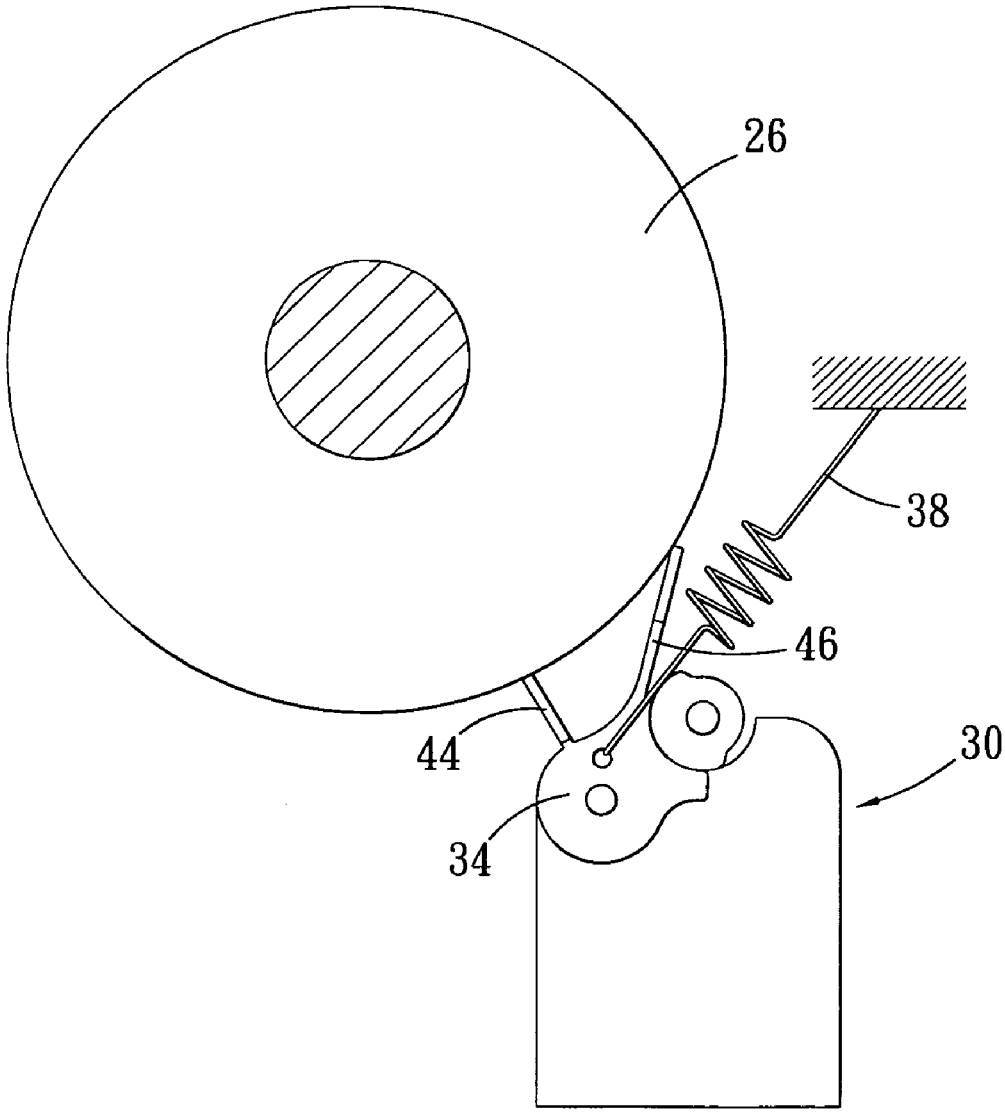
FIG. 5 is an illustrative view of showing the automatic clean device of the present invention contacting another type photoconductor.

Referring to FIG. 5, wherein a photoconductor 26 can be formed in the shape of a long drum, the cleaning device 30 is disposed at a side of the photoconductor 26, the first and the second blades 44, 46 of the cleaning element 34 can be driven by the transmission 36 and the elastic member 38, so as to contact or disengage from the surface of the photoconductor 26.

In the above embodiments of the present invention, both the circular strip-shaped photoconductor 20 and the long drum-shaped photoconductor 26 are big enough for matching the width of the printing area. In this case, both the first and the second blades 44, 46 of the cleaning element 34 are wide enough to match the width of the photoconductors 20, 26.

The above-mentioned transmission element 36 is only one of the preferred elements, it also can be in form of an eccentric cam or a connecting rod structure. Both of the eccentric cam and the connecting rod structure can be the equivalents of the transmission element 36 because they are able to cause oscillation of the cleaning element 34.

The cleaning element 34 has the first and the second blades 44, 46, both of which form a "V" shape with each other. This is a preferred embodiment of the present invention. In operation, when the first and the second blades 44, 46 touch the surface of the photoconductor 20, 26, they will counteract to each other so as to prevent deflection or deformation of the cleaning element 34 caused by the photoconductor 20 overly deflecting toward and pressing on only one of the blades.

The present invention has the following advantages as compared with the prior arts:

First, with the help of the elastic member 38 and the transmission element 36, the cleaning element 34 is possessed with the function of self-guiding, such that, in operation, the cleaning element is able to precisely and steadily contact the photoconductor 20 so as to improve the cleaning effect.

Second, in the initial rotation course of the photoconductor 20, the cleaning element 34 will not touch the photoconductor 20 until the portion on the surface of the photoconductor 20 attached with remainders of powered carbon rotate to approach the cleaning element 34. By this way, the time of the photoconductor 20 touching the cleaning element 34 is shorter than that of the prior arts. Thereby, after long time of usage, the abrasion on the photoconductor 20 will be relatively light as compared to the prior arts.

Third, the cleaning element 34 has the first and the second blades 44, 46 employed to contact the photoconductor 20, besides providing a better cleaning effect, they also counteract to each other so as to prevent deflection or deformation of the cleaning element 34 which caused by the photoconductor 20 overly inclining toward only one of the blades.

While we have shown and described various embodiments in accordance with the present invention, it should be clear to those skilled in the art that further embodiments may be made without departing from the scope of the present invention.

What is claimed is:

1. An automatic clean device, which is disposed at a side of a photoconductor wherein the photoconductor can attract imaging material and can move reciprocatedly, the automatic clean device comprising:

a base body;

a cleaning element swingingly disposed on the base body, which has at least a blade, the cleaning element being able to move in oscillating manner, to make the blade touch on the surface of the photoconductor;

an elastic member, an end of which is fixed and another end of which is fixed to the cleaning element; and a transmission member including a push portion and an arresting portion and serving to drive the cleaning element, by cooperating with the elastic member, the transmission can effect oscillation of the blade so as to make the blade touch or disengage from the photoconductor;

wherein the cleaning element is formed with an arc-shaped groove, the push portion of the transmission member is arc-shaped to engage the arc-shaped groove of the cleaning element in order to make the cleaning element move in oscillating manner.

2. The automatic clean device as claimed in claim 1, wherein the cleaning element is provided with two blades, and the two blades are oppositely located by forming a "V" shape.

3. The automatic clean device as claimed in claim 1, wherein the transmission element is a cam.

4. The automatic clean device as claimed in claim 1, wherein the transmission element is an eccentric cam.

* * * * *